US007861440B2

(12) United States Patent
Ma et al.

(10) Patent No.: US 7,861,440 B2
(45) Date of Patent: Jan. 4, 2011

(54) IRONINGBOARD ADUSTABLE IN HEIGHT

(75) Inventors: Kok Wah Ma, Singapore (SG); Derrick Wai Thong Loke, Singapore (SG); Mong Hua Tan, Singapore (SG); Mohankumar Valiyambath Krishnan, Singapore (SG); Chandra Mohan Janakiraman, Singapore (SG); Swee Loon Michael Tang, Singapore (SG); Choon Hwee Tan, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 457 days.

(21) Appl. No.: 11/993,314

(22) PCT Filed: Jun. 27, 2006

(86) PCT No.: PCT/IB2006/052115

§ 371 (c)(1),
(2), (4) Date: Dec. 20, 2007

(87) PCT Pub. No.: WO2007/004122

PCT Pub. Date: Jan. 11, 2007

(65) Prior Publication Data

US 2010/0146827 A1 Jun. 17, 2010

(30) Foreign Application Priority Data

Jun. 30, 2005 (EP) ..... 05105947

(51) Int. Cl.
*D06F 81/04* (2006.01)
*A47B 9/00* (2006.01)

(52) U.S. Cl. ..... 38/137; 38/139; 108/144.11

(58) Field of Classification Search ..... 38/103–139; 108/144.11–147, 147.19; 248/157, 422, 248/423, 188–188.91
See application file for complete search history.

(56) References Cited

U.S. PATENT DOCUMENTS

| | | | | |
|---|---|---|---|---|
| 2,427,829 | A * | 9/1947 | Amato | 38/104 |
| 2,485,193 | A | 10/1949 | Foglio | |
| 2,594,123 | A | 4/1952 | Cater | |
| 3,288,090 | A * | 11/1966 | King | 108/138 |
| 4,956,929 | A * | 9/1990 | Chirabandalsuk | 38/136 |
| 6,443,075 | B1 * | 9/2002 | Hahn et al. | 108/147 |
| 6,796,059 | B2 * | 9/2004 | Denisart et al. | 38/137 |
| 2001/0037751 | A1 * | 11/2001 | Agee | 108/147 |
| 2003/0172558 | A1 * | 9/2003 | Couch et al. | 38/107 |
| 2004/0064980 | A1 * | 4/2004 | Di Leta | 38/137 |

FOREIGN PATENT DOCUMENTS

| | | |
|---|---|---|
| CA | 2225067 | 7/1999 |
| DE | 7537365 | 3/1976 |
| DE | 8516200 | 3/1989 |

(Continued)

*Primary Examiner*—Ismael Izaguirre

(57) ABSTRACT

An ironing board includes a base, a body with a work surface and an easy height-adjustment operation to adjust the distance of the body relative to the base. A column extends between the body and the base and is equipped with a stationary frame secured to the base and a moveable frame secured to the body. In order to decrease the force needed to adjust the height of the body relative to the base, the height adjustment device includes device for exerting a repelling force between the body and the base.

18 Claims, 13 Drawing Sheets

FOREIGN PATENT DOCUMENTS

Figure 1:
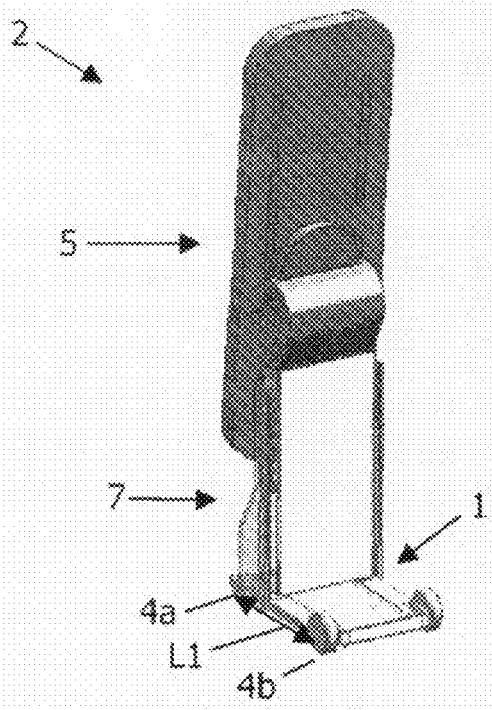

| | | |
|---|---|---|
| EP | 0118398 | 9/1984 |
| EP | 0270827 A1 | 5/1988 |
| EP | 0875173 B1 | 11/1998 |
| FR | 2695145 | 4/1994 |
| GB | 2394965 | 5/2004 |
| JP | 03297499 | 12/1991 |

* cited by examiner

IRONINGBOARD ADUSTABLE IN HEIGHT

The invention relates to an ironing board comprising a base, a body with a work surface, which work surface is connected to the base and a height adjustment means to adjust the distance of the body relative to the base. The invention also relates to a system comprising an ironing board and an iron and/or a garment steamer.

Ironing boards are used by users of different heights. In order to be able to work at a comfortable height, the user wishes to be able to adjust the height to his/her need. Commonly known ironing boards are equipped with X-legs, the legs being joined at a centre area to form a pivot for height adjustment. The legs will move towards or away from each other during the height adjustment process, respectively, in a scissor-like movement. In general the footprint becomes smaller when the body is positioned higher. To fix the height of the work surface, height stoppers are used. The height stoppers are normally lever-ratchet or hook-in-hole designs.

During the scissor-like height adjustment the legs move and there is a risk for the user of getting a hand between the legs or between the legs and body of the ironing board. This may result in an injured hand. Further there is a risk that the legs may accidentally run over a user's foot and injure the foot.

It is an object of the invention to provide an ironing board which can be adjusted in height in an easy way and with little effort and which substantially reduces the risk of the above mentioned injuries during use.

This object is achieved by the ironing board according to the invention, which board comprises a column equipped with a stationary frame secured to the base, a moveable frame secured to the body and a means for exerting a repelling force between the body and the base.

In normal use the column is substantially vertical and the force is directed upwards. This implies that the repelling force reduces the force that the user needs to adjust the height of the body and thereby the height of the work surface.

The height adjustment means can be activated at any time if required by the user; during setting up, ironing interval, or storing of the ironing board. To set up an X-legged ironing board it is often placed almost at floor level before it is raised to the required height, and vice versa. With the ironing board according to the invention there is no movement of (X-)legs or a change in foot print size during the height adjustment. This prevents foot injury during setting up and storing of the ironing board.

In an embodiment of the ironing board according to the invention the movable frame is movable alongside the stationary frame. The stationary frame may have a guiding means, e.g. a slider pack, for guiding the movable frame. The guiding means may be virtually concealed and thus prevent injury to the fingers during the height adjustment process.

In the ironing board according to the invention the column may comprise mechanical or electromachinal weight compensation means, such as spring members, motor(s), etc., to counter the weight of the body. In this way the user needs to apply reduced force to move the board up and down to set a desired height of the work surface.

An example of a weight compensation means suitable for the ironing board according to the invention is a constant-force spring. A constant-force spring is a special variety of extension spring. Usually it comprises a tightly coiled wound band or flat strip with built-in curvature, so that each turn of the strip wraps tightly on its inner neighbour. When the strip is extended (deflected) the inherent stress resists the loading force, the same as a common extension spring, but at a nearly constant (zero) rate. In use, one end of the band is usually wrapped on a drum and the free end is attached to the loading force, such as in a counterbalance application. A fastening means such as an axle or a shaft etc. may be present in the center of the drum.

In an embodiment of the board according to the invention the free end of the constant-force spring is fixed to the stationary column. The moveable frame sits on the fastening means of the constant-force spring.

In another embodiment the free end of the constant-force spring is fixed to the moveable frame and the fastening means of the constant-force spring is fixedly connected to the stationary frame.

In case the column comprises multiple movable frames, the free end of the force spring will preferentially be connected to the movable frame connected to the work surface. In this way the constant-force spring pulls the upper moveable frame, i.e. the frame closest to the body, and takes along with it the frames in between the upper and the stationary frame, and facilitates the height adjustment. In another embodiment the free end of the constant-force spring is secured to the stationary frame and the fastening means of the constant-force spring is connected to the movable frame.

Alternatively, the weight compensation means may comprise a counterweight connected via a pulley, for instance in a way as used in conventional elevators.

The ironing board according to the invention may comprise a multiple-step stopper that allows the user to select the appropriate height. This stopper may comprise ratchet(s), gear-latch(es) combination mechanism or any other means the person skilled in the art may find appropriate to fix the height with. For directing the stopper a lever or a button may be used. For height adjustment the user activates the lever or button, moves the ironing board up or down, and releases the lever or button when the required height is reached.

In an embodiment of the board according to the invention the stationary frame is fixed to a base plate. The movable frame is incorporated inside or outside the stationary frame. The two frames are held together by bearings such as one or more slider packs, rollers, etc.

A gear train having multiples slots may be fixed at a side of the stationary frame and provides steps for height adjustment. A latch, positioned at a side of the movable frame facing the stationary frame, may be used as a stopper to fix the height after adjustment to the desired position. A lever or a button may be provided at the movable frame and near the body, to activate or stop height adjustment. The lever or button may be linked to a first end of a link rod. A second end of the link rod may be linked to the latch. By activating, i.e. pulling or pressing, the height adjustment lever or button, the link rod will release the latch from the gear train slot, and this allows the movable frame to move freely in its intended direction.

Alternatively, two levers or buttons may be provided; in this way the user can use both hands to set the height.

When the required height is reached, the user will release the lever(s) or button(s), whereby the latch(es) will lodge into one of the gear train slots and lock the movable frame in position, preventing further movement of the mechanism.

Special care is usually taken in placing an article to be ironed in a flat manner on the work surface of the body. Doubled or folded fabric of the article could—if not taken care of—lead to a self-induced fold or artificial wrinkles in the article after ironing. This is an unwanted effect. In an embodiment of the ironing board according to the invention the ironing board is equipped with means to blow or suck air through a permeable work surface. The body may be made of permeable material or of solid material provided with holes and a permeable cover, for instance made of a textile. The blowing of air through the permeable work surface helps to place the article in a flat manner. The air provides a certain cushion on which the article can be placed in a flat or stretched manner. After the article is placed, the direction of the fan might be changed to suction (for instance by pushing a control button on the iron). Now the fabric of the article, after being placed in a flat manner on the air cushion, is sucked in a flattened manner to the work surface and now ready for ironing, thus reducing the risk of unwanted self-induced folds.

The ironing board according to the invention is particularly beneficial in case it has additional weight because it is equipped with for instance a fan for blowing air through the body and/or a boiler for providing steam. Having to apply a minimum force to adjust the height of the work surface makes it easy to use.

In another embodiment of the ironing board according to the invention the board has a chamber to accommodate appliances such as an iron, a steam iron and/or a garment steamer. This could be a cabinet with a drawer on or in the column in which the user can store for instance an iron when not in use.

Means to operate such appliances might also be provided. These means are for instance a water tank for providing water, a boiler, for generating steam (from the water from the water tank) and supplying steam to an inlet of the iron and a power supply for supplying power. In this way the ironing board and the iron form and cooperate as a system. Alternatively, the steam may be supplied to an inlet of the garment steamer, if present. In this way the ironing board and the garment steamer form and cooperate as a system.

In another embodiment the ironing board may also be provided with means to heat up the work surface. In this way the fabric of the article is warmed from the work surface side, for instance using a hot electric spiral located in the body. Alternatively, a flexible heating element may be attached, e.g. sewn into the cover.

In case the ironing board according to the invention is equipped with a fan and/or a heater, a power supply is needed to supply power to these functions.

A concept of an ironing board comprising a column-like set up instead of X-legs is described in FR 2695145. This document hardly provides technical information about how such a set-up could work.

With reference to the claims it is further noticed that the invention also refers to all possible combinations of features as described in the claims.

Figure 2:
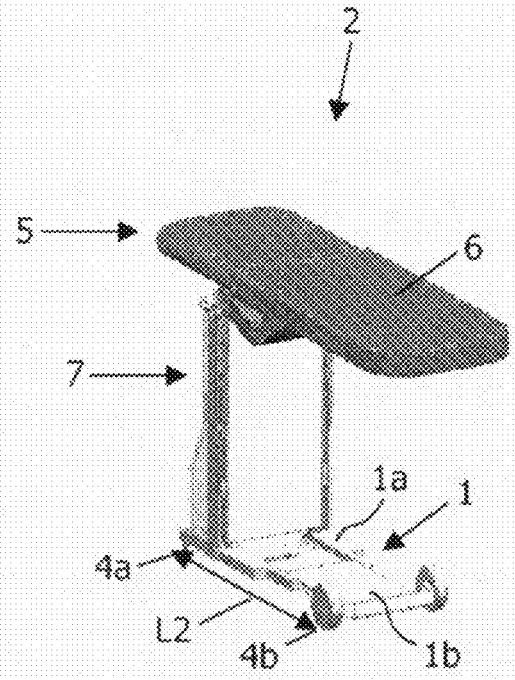
Figure 4:
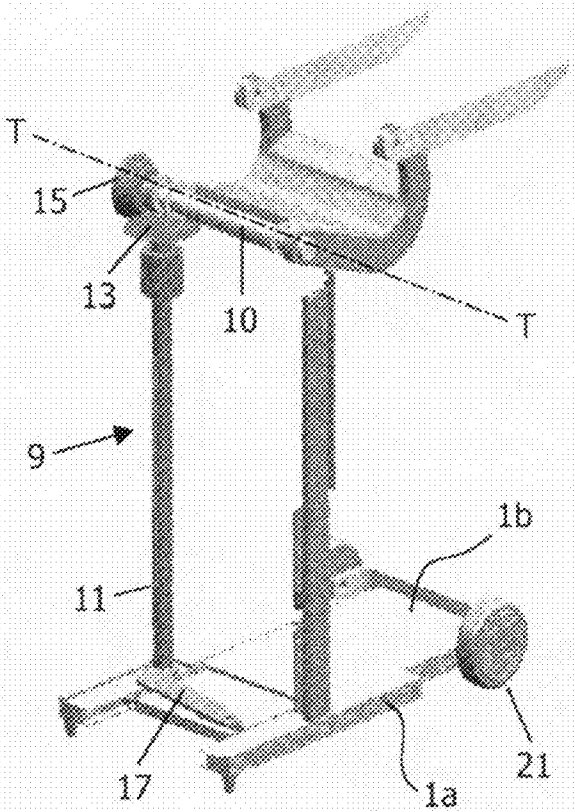
Figure 3:
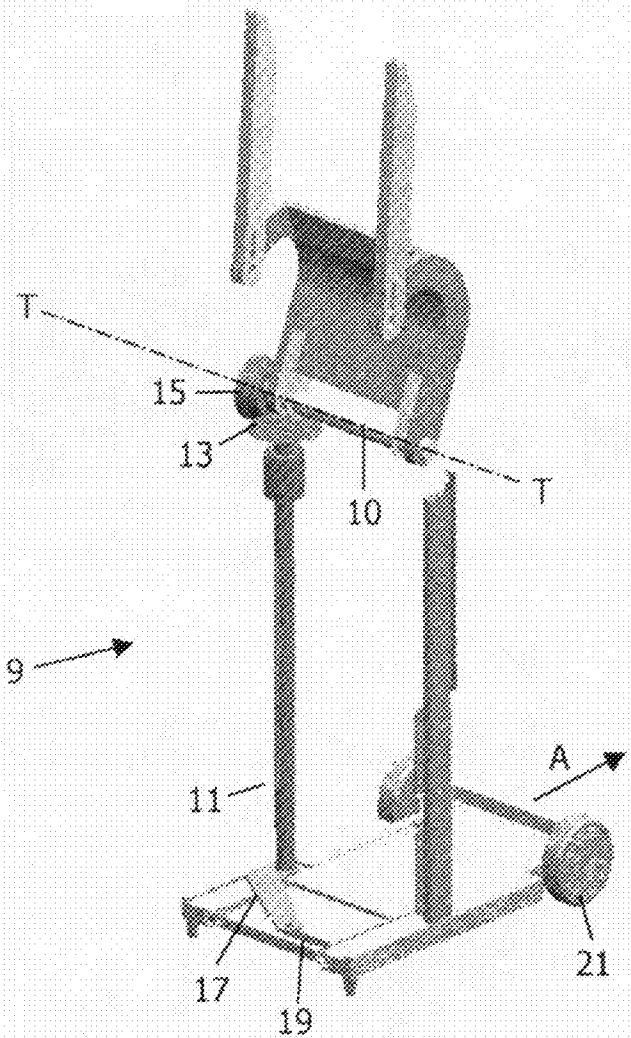
Figure 6A:
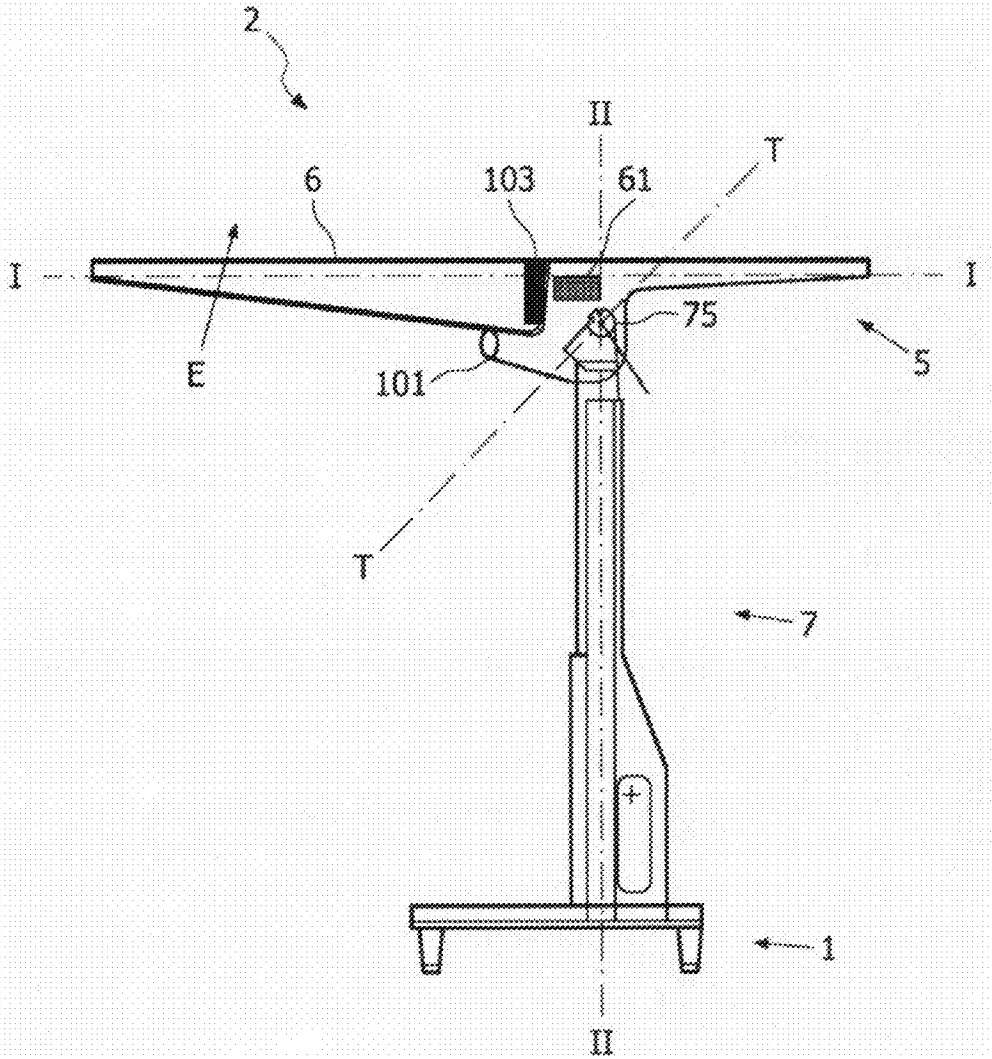
Figure 5:
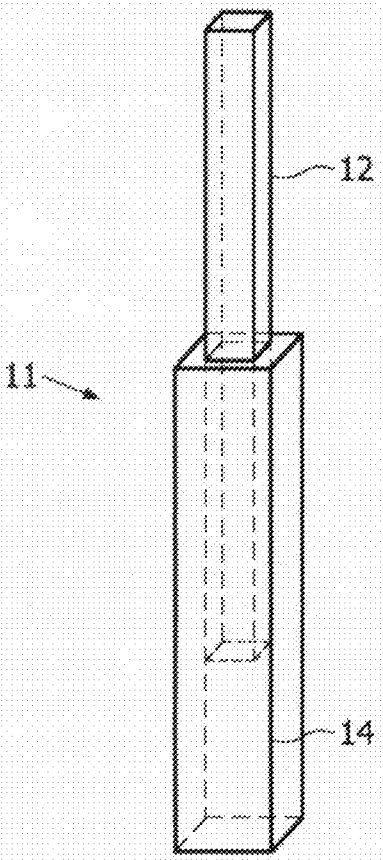
Figure 6B:
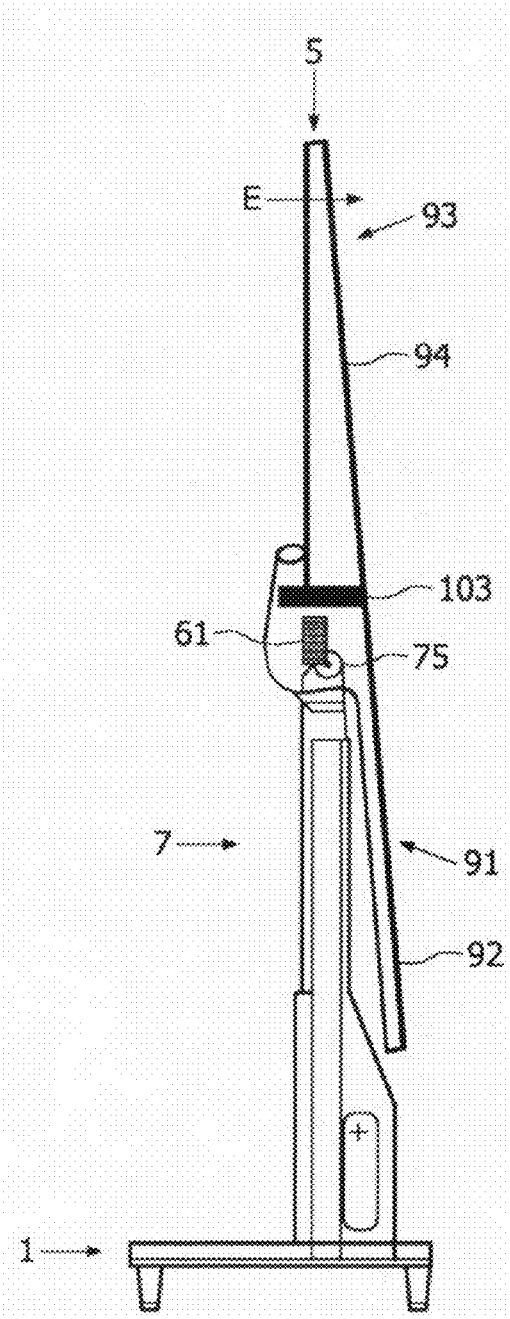
Figure 6C:
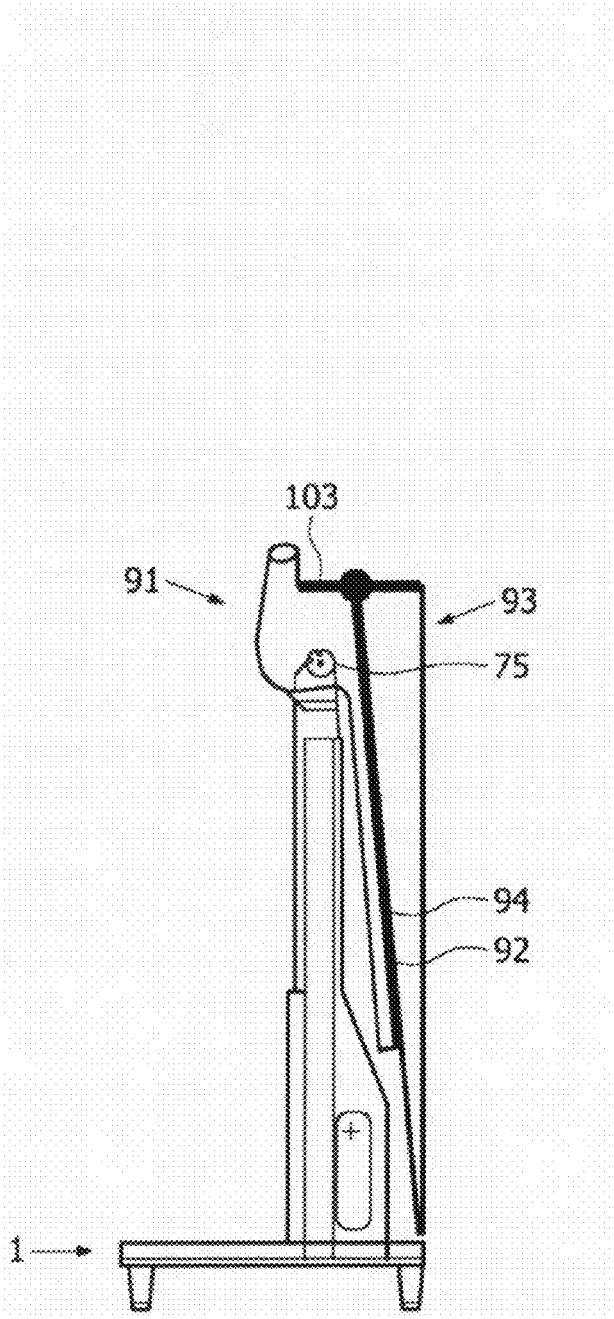
Figure 7:
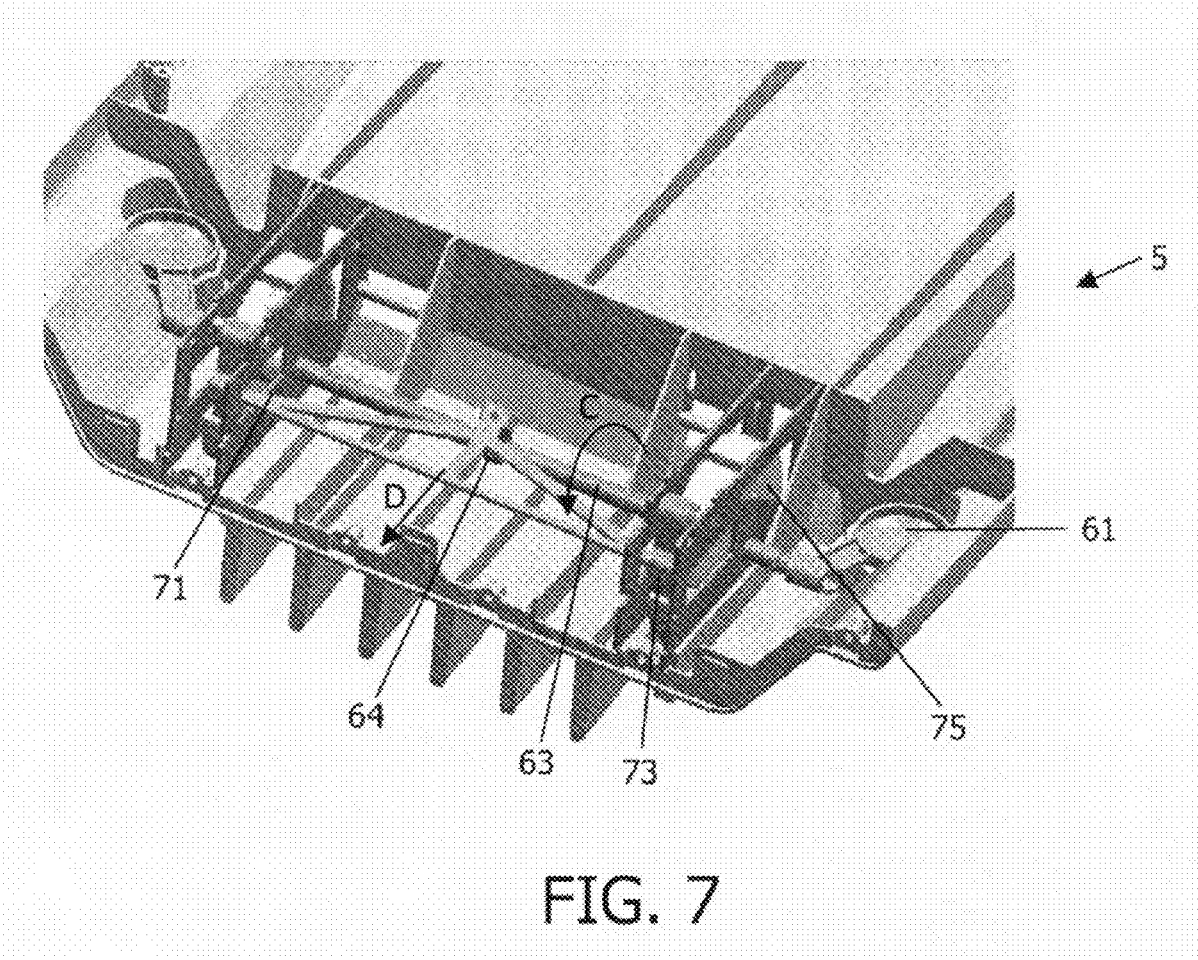
Figure 8:
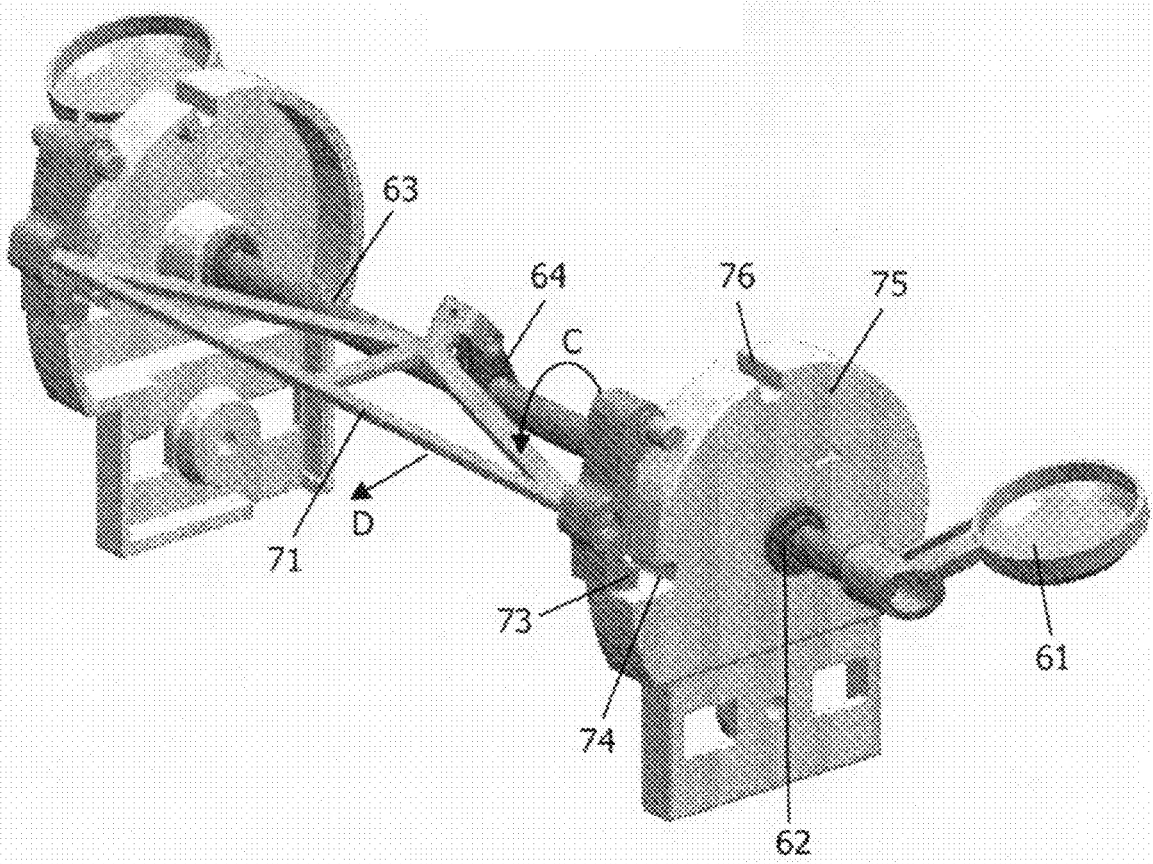
Figure 9:
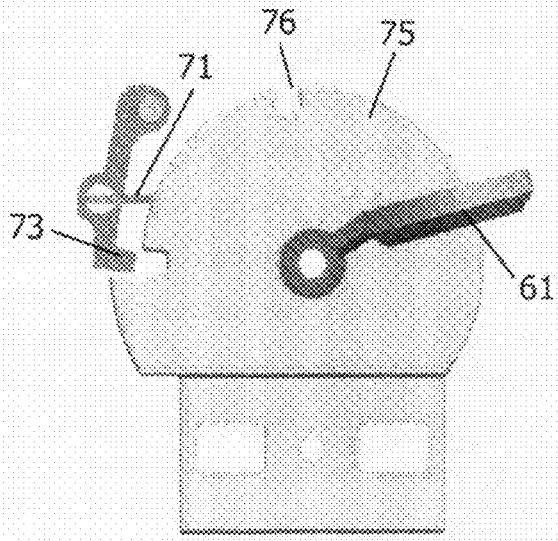
Figure 10:
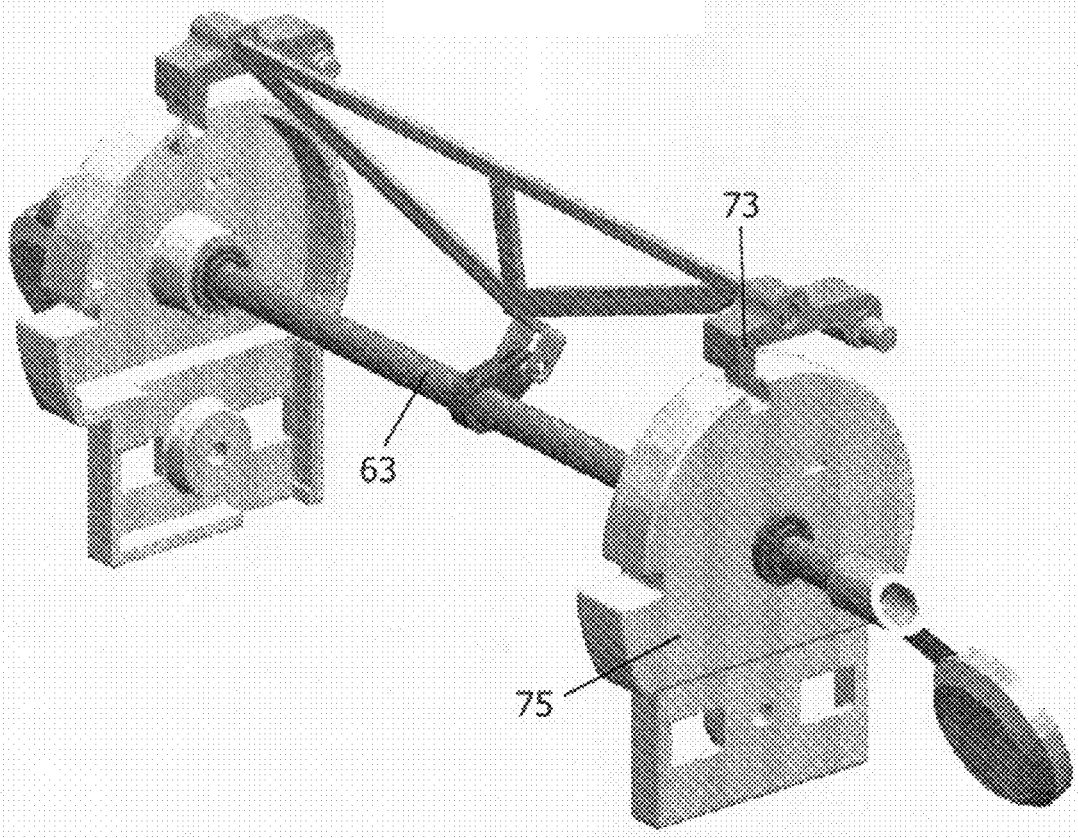
Figure 11A:
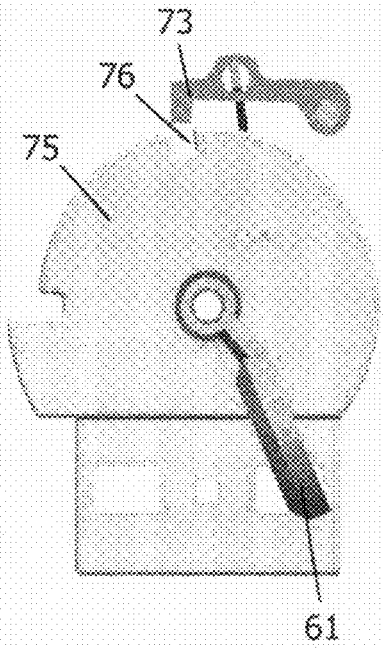
Figure 11B:
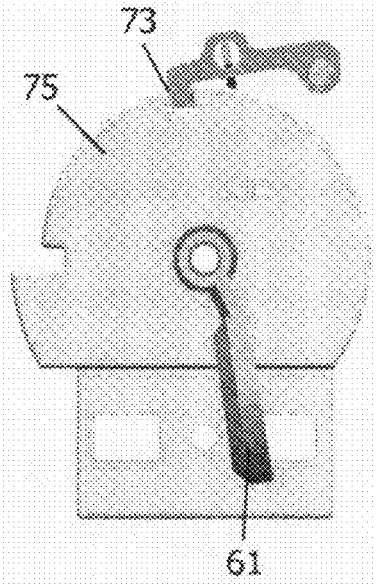
Figure 12:
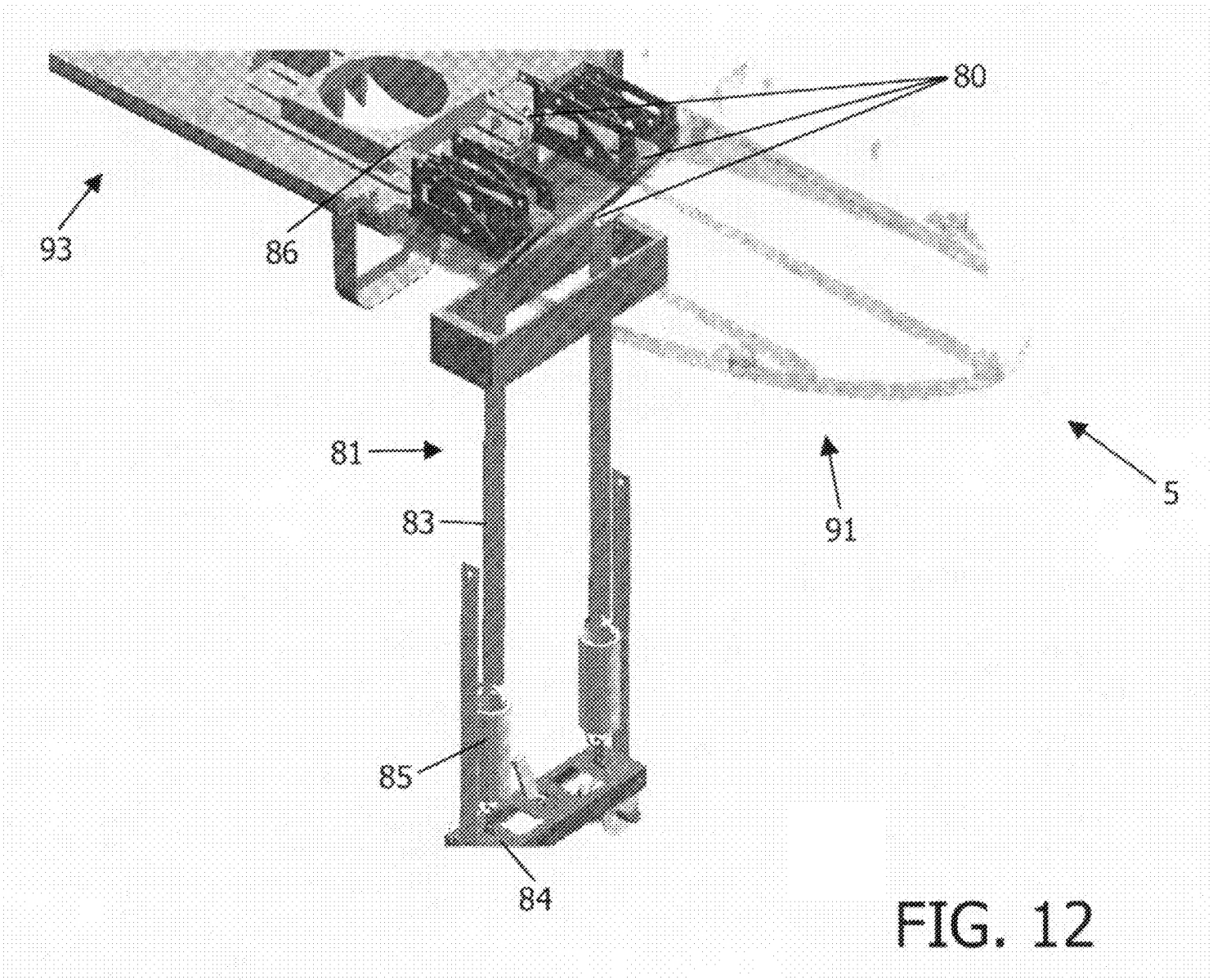
Figure 13:
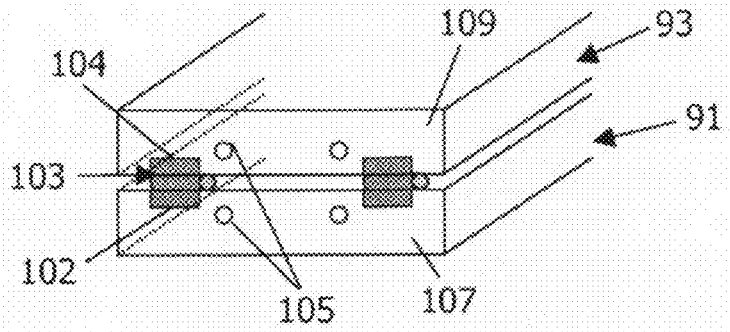
Figure 14:
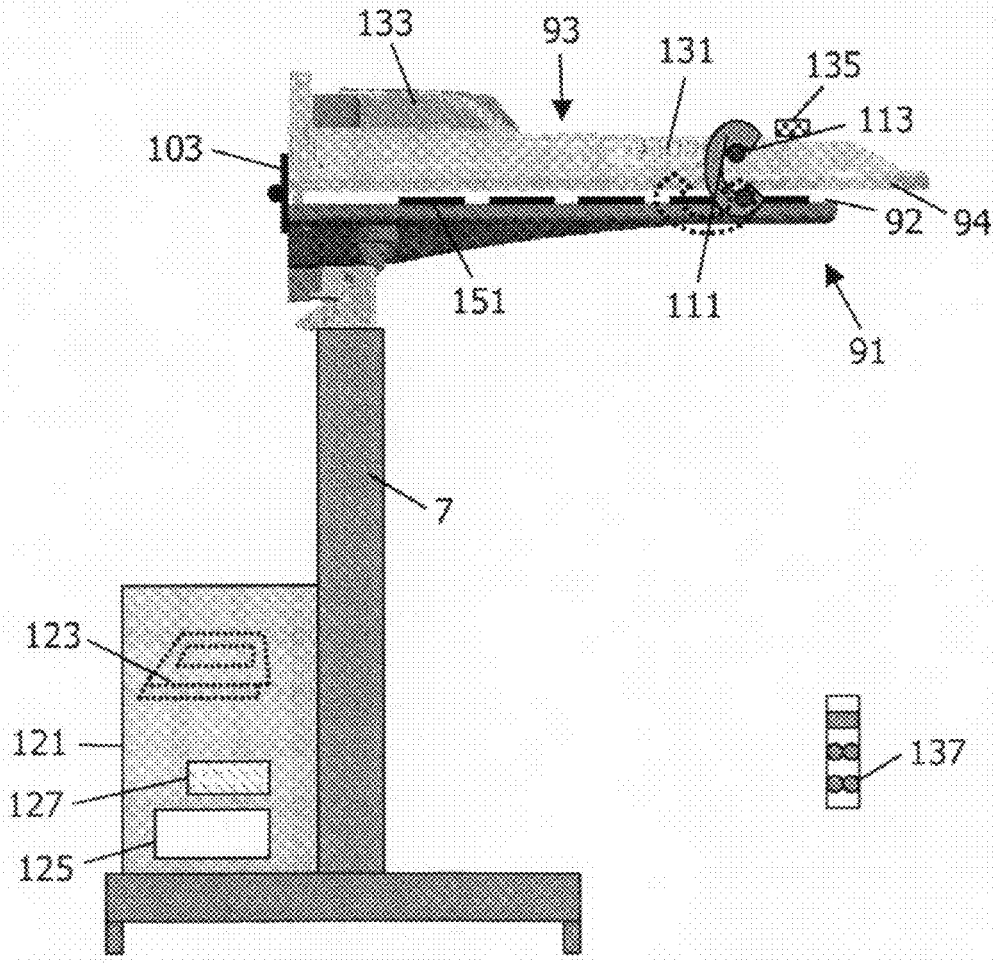
Figures 15A, 15B:
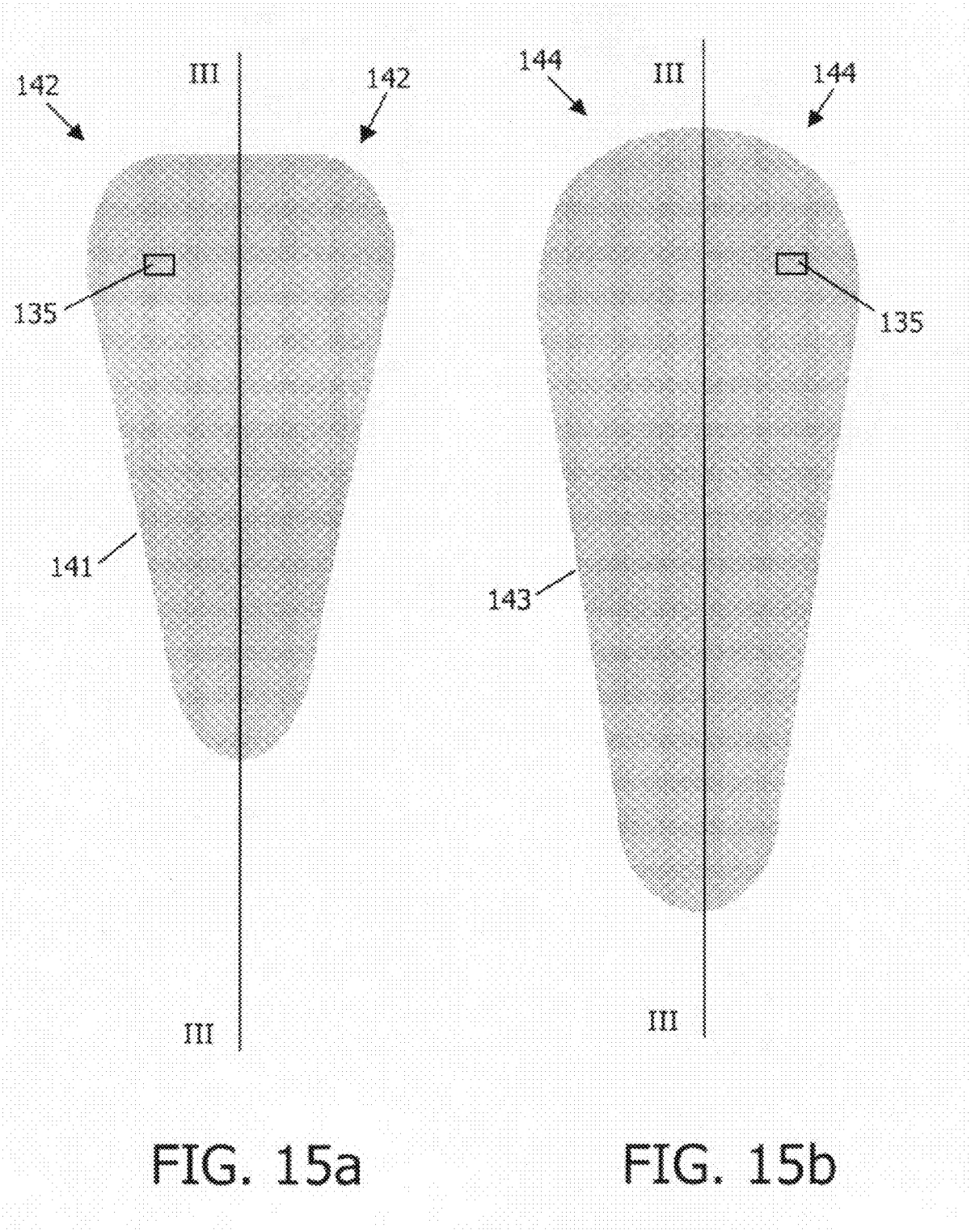
Figure 16:
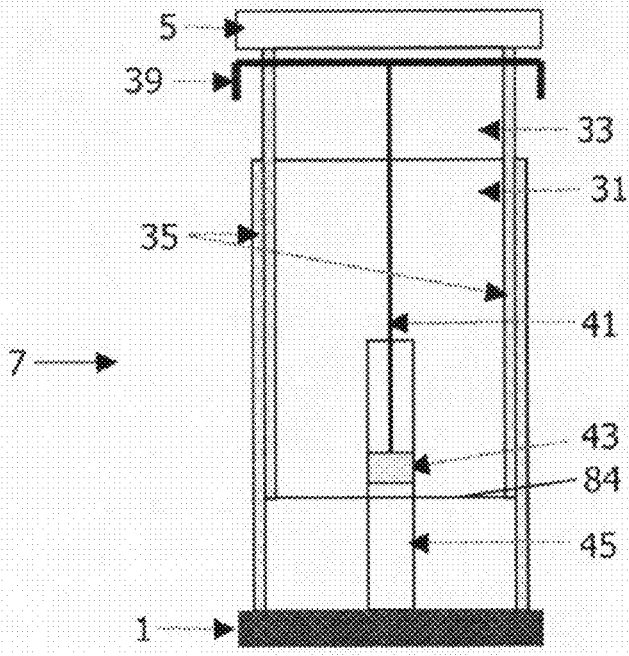
Figure 17:
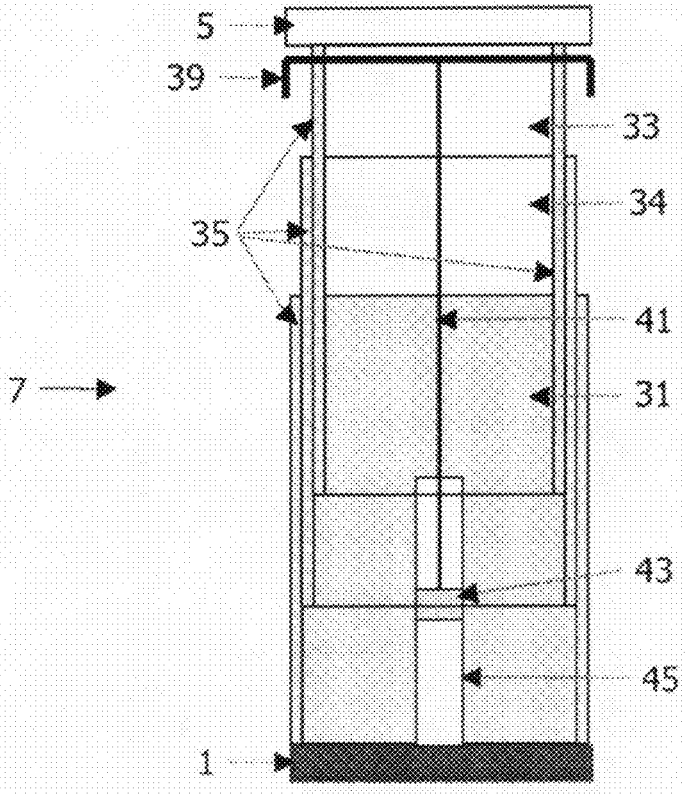
Figure 18:
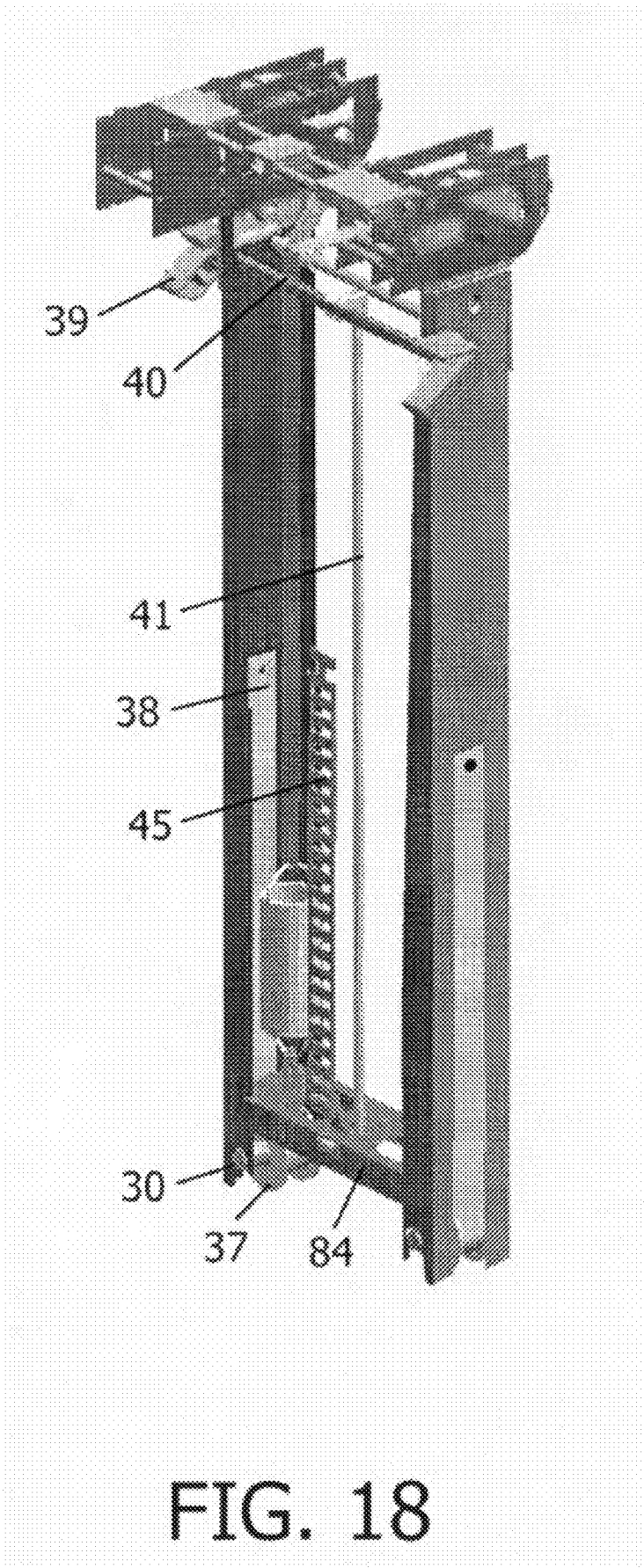
Figure 19:
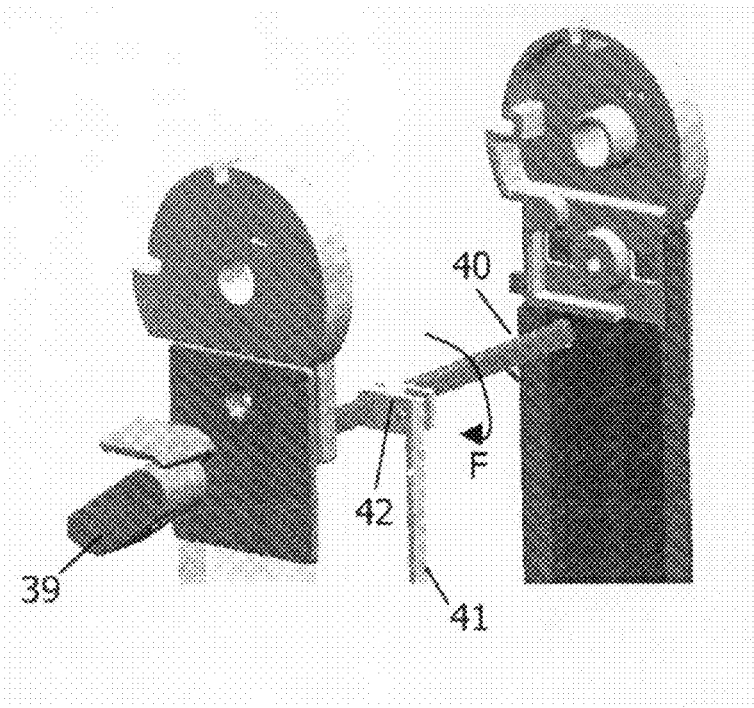
Figure 20:
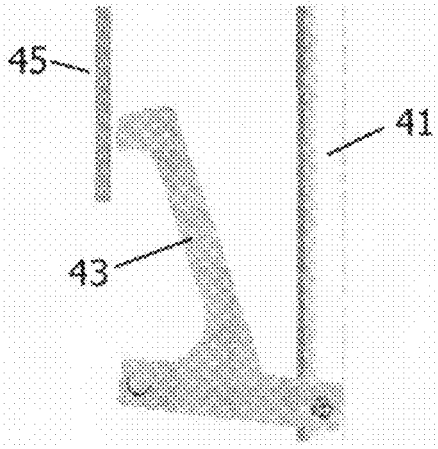

The invention will now be described by way of example with reference to the accompanying drawings. In principle all aspects can be combined. In the figures the same numbers are being used for the same or equivalent features, in which:

FIG. 1 schematically depicts a first embodiment of an ironing board according to the invention with the body in a substantially vertical position, FIG. 2 schematically shows the ironing board of FIG. 1 with the body in a substantially horizontal position, FIG. 3 schematically shows an adjustment mechanism for the ironing board according to the invention with the body in a substantially vertical position, FIG. 4 schematically shows the adjustment mechanism for the ironing board of FIG. 3 with the body in a substantially horizontal position, FIG. 5 schematically shows an embodiment of a detail of the adjustment mechanism, FIG. 6*a* schematically depicts a second embodiment of the ironing board according to the invention, FIG. 6*b* schematically depicts the embodiment of FIG. 6*a* with the body in a substantially vertical position, FIG. 6*c* schematically depicts the embodiment of FIG. 6*a* in a folded position, FIG. 7 schematically shows a tilting means for the ironing board according to the invention, FIG. 8 schematically shows a detail of the tilting means of FIG. 7 in perspective, FIG. 9 schematically shows a side view of a detail of FIG. 8, FIG. 10 schematically shows a detail of the tilting means of FIG. 7 in perspective in another position, FIG. 11*a* schematically shows a side view of a detail of FIG. 10 in a first position, FIG. 11*b* schematically shows a side view of a detail of FIG. 10 with the protrusion in a second position, FIG. 12 schematically shows a detail of a third embodiment of an ironing board according to the invention, FIG. 13 schematically shows an air guiding means for the ironing board according to the invention, FIG. 14 schematically shows an embodiment of the ironing board according to the invention in a pressing mode, FIG. 15*a* schematically depicts a first embodiment of a torso-shaped body according to the invention, FIG. 15*b* schematically depicts a second embodiment of a torso-shaped body according to the invention, FIG. 16 schematically shows an embodiment of the height adjustment means of an ironing board according to the invention, FIG. 17 schematically shows an alternative embodiment of the height adjustment means of an ironing board according to the invention, FIG. 18 schematically shows an embodiment of a weight compensation means as part of an embodiment of a height adjustment means for an ironing board according to the invention, FIG. 19 schematically shows an enlarged detail of the height adjustment means of FIG. 18 and FIG. 20 schematically shows another enlarged detail of the height adjustment means of FIG. 18.

The figures will now be described in detail and reference is made to the numbers in the figures. In FIG. 1 an embodiment of an ironing board 2 having a body 5, a base 1 and a column 7 is depicted. The body 5 is in a substantially vertical position and the base 1 has a length L1. In FIG. 2 the body 5 is in a substantially horizontal position and the base 1 has a length L2, which is larger than L1. FIGS. 1 and 2 together illustrate the relation between the position of the body 5 with a work surface 6 and the length of the base 1. The length of the base 1 is the distance between the contact points (4*a* and 4*b*) with the floor during use. The base 1 comprises a first base part 1*a* and a second base part 1*b*. The first base part 1*a* is attached to the column 7 and the second base part is slidable along the first base part 1*a*.

In FIG. 3 an adjustment mechanism 9 is shown with the body 5 in a substantially vertical position. The body 5 (not shown in FIG. 3) is connected to a rod 10 that enables the body to be tilted along a tilting axis T-T. As the body 5 is tilted along tilting axis T-T towards the horizontal position (as shown in FIG. 4), the rod 10 begins to turn. This brings about a rotational movement of a crown wheel 15 connected to the rod 10. This crown wheel as a result rotates a further crown wheel 13 connected to the vertical shaft 11 serving as a rotation axis. Thus the vertical shaft 11 is rotated counter clockwise. This rotation of the shaft 11 moves a base lever 17 in a slit 19 and consequently the base 1 slides out as illustrated by arrow A. The base is preferably equipped with sliding means, e.g. wheels 21. The result of this movement is shown in FIG. 4.

FIG. 5 schematically shows an example of the shaft 11 comprising a first telescopic part 12 and a second telescopic part 14, which are not rotatable relative to each other because they have a non-circular cross-section. Such a shaft may be used in an embodiment of the invention where the retractable/elongateable base feature is combined with height adjustment. A shaft comprising telescopic parts allows the distance between body and base to be varied In FIG. 6*a* the second embodiment of the ironing board 2 according to the invention is depicted comprising a base 1 and a body 5 with a work surface 6, the body having a first longitudinal axis I-I. The ironing board further has a column 7, having a second longitudinal axis II-II. The tilting axis T-T extends substantially perpendicularly to both the first axis and the second axis. FIGS. 6*a* and 6*b* illustrate two positions that can be obtained by tilting the board with the body having a stretched-like state.

In FIGS. 7 to 11*b* details of the tilting means are depicted.

In FIG. 7 is shown that the body 5 (shown in part) of the ironing board is rotatably connected to an axle 63. The axle 63 in this example is an embodiment of the tilting axis T-T (as shown in FIG. 6*a*). The embodiment comprises a first button 61, connected to the axle 63. The axle 63 is connected to a triangle 71 via a first connector 64. The triangle 71 is connected to a clamp protrusion 73, which is arranged for cooperation with a pivot plate 75. The pivot plate 75 has a first slot 74 and a second slot 76 (as shown in FIG. 8).

The tiling will now be described with reference to the figures. The starting point of the description is the body in a substantial horizontal position as depicted in FIG. 6*a*. If the user pushes the first button 61 in the direction of the body, the axle 63 rotates as illustrated by arrow C in FIG. 7. Hence, the triangle 71, coupled to the axle 63 via the first connector 64, is pushed in the direction of arrow D (see also FIGS. 8 and 9). As a result the clamp protrusion 73 is released from the first slot 74 located in the plate pivot 75. If the user, simultaneously with pushing the first button 61, exerts a force in the direction of an arrow E (see FIG. 6), the body 5 rotates and the clamp protrusion 73 slides along the plate pivot 75 to the next available slot, in this case the second slot 76 (see FIGS. 10 and 11*a*). If the user releases the first button 61, the clamp protrusion 73 fits in the second slot 76 (see FIG. 11*b*). Because the body 5 is connected to the axle 63 the result is that the body 5 is tilted along the rotation axle 63 to a substantially vertical position; in this case about 81 degrees relative to the horizontal plane. This is illustrated in FIG. 6*b*.

In the second embodiment the body 5 (see FIG. 6*b*) has a first part 91 having a first work surface 92 and a second part 93 having a second work surface 94, the first and second parts being connected by a hinge 103 serving as folding means. The first part 91 may be provided with a support element 101 for supporting the second part (see FIG. 6*a*). A first part of the hinge 102 is secured to the first part of the body 91 and a second part of the hinge 104 is secured to the second part 93 of the body (see FIG. 13).

The folding of the body of the ironing board will now be explained. The starting point of the description is the body in a substantial vertical position as depicted in FIG. 6*b*.

If the user pushes the first button (61) in the direction of the body, the clamp protrusion 73 is released from the second slot 76 in the plate pivot 75 (see FIG. 11*a*). If the user, simultaneously with pushing the first button 61, exerts a force in the direction of the arrow E on the second part 93 of the body, this second part is folded towards the first part. The first work surface 92 and the second work surface 94 now face each other. This is illustrated in FIG. 6*c*. In this mode the ironing board according to the invention can be stored easily and in a compact manner.

In order to prevent the second part 93 of the body from slamming down on the first part 91 and to accompany the folding process, a resilient element 81 is provided. In FIG. 12 an embodiment of the resilient element 81 is shown. In this embodiment the resilient element comprises a strap 83 fixed to a spring 85. One end of the strap 86 is connected to the second part 93 of the body and the other end of the strap is connected to the spring 85. The spring is secured to the first bottom part of the column 84. The first bottom part 84 is part of a moveable frame 33 of the column 7 (shown in FIG. 16 and explained later).

The shifting of the position of the body 5 in the second embodiment from substantially horizontal (stretched state like in FIG. 6*a*) to substantially vertical (stretched state like in FIG. 6*b*) might result in unwanted folding of the body. In order for the tilting of the body to prevail over premature folding, the resilient element 81 (see FIG. 12) is selected and constructed in such a way that the resilient force is stronger than the force needed to tilt the body, thus keeping the parts together while tilting the body 5. In FIG. 12 it can be seen that the course of the resilient element 81 leads through the column (not shown), through the first part of the body 91 and ends in the second part of the body 93. The strap is secured to the second part 93 at the location indicated by number 86 (FIG. 12). Depending on the weight of the body a skilled person can select the force of the resilient element. This could be the force of the spring 85. The strap and the spring may be substituted by for instance an elastic band (not shown). In that case the force of the elastic band can be selected by the skilled person. A guiding means 80 guides the course of the resilient element. An example of the guiding means is a roller known per se.

To keep the first part 91 of the body and the second part 93 of the body in a stretched state during tilting, alternatively a fixation means (not shown) might be provided.

This fixation means may be a hinge or spring-loaded hinge, known per se, which has two stable positions e.g. open position and closed position.

Alternatively, the fixation means may comprise a protrusion secured to the first part of the body close to the first part of the hinge (102, see FIG. 13) cooperating with a receiving means secured to the second part of the body close to the second part of the hinge 104 (FIG. 13). The cooperation is done in a way known per se, so the first and second part of the body are fixated in their stretched state. The protrusion could be a hook and the receiving means a socket, these are known per se. In such an embodiment the user would have to release the hook from the socket before the body can be folded. In practice it would function as a locking/unlocking means between the parts of the body.

In FIG. 14 an embodiment of the board according to the invention in a pressing mode is depicted. This embodiment comprises a hook 111 fixed to the first part 91 of the body and a body protrusion 113 secured to the second part 93 of the body. This could also be the other way around. The body protrusion 113 serves as a receiving element. The skilled person can select alternative known hook-shaped elements and known receiving elements and fix them to the first part 91 and second part 93 of the body respectively in such a way that the elements can cooperate. A touch button 135 serves as a control unit for an electrical unit (not shown). The electrical unit is arranged for activating a fan 133.

A way of pressing an article using an ironing board according to the invention will now be described. The body in a horizontal position (ironing mode) (FIG. 6*a*) is taken as starting point. An article 151 is placed on the first work surface 92 of the first part 91 of the body. The second part 93 of the body is folded towards the first work surface 92. The first part 91 of the body will remain latched on the pivot plate 75 (in the horizontal position). In this way the first 92 and second work surface 94 are facing each other and at least a portion of the article 151 is located in between. Now the parts 91, 93 are clamped together. This is done by moving the hook 111 around the body protrusion 113. If the touch button 135 is pushed, the fan 133 is activated resulting in an air stream flowing through the second work surface 94 of the second part of the body and through (part of) the article 151. A board heater (if present, not shown) may be activated to provide heat during the pressing operation.

In an embodiment according to the invention the control unit for activating the fan 133 comprises a remote control 137.

In FIG. 14 it is furthermore shown that an embodiment of the ironing board according to the invention may be provided with a chamber 121 or e.g. a drawer for accommodating appliances, for instance an iron 123 and if present, a garment steamer. In this way the board has means for storing the iron and/or garment steamer.

In an embodiment of an ironing board according to the invention the ironing board is arranged for housing at least one of a water tank 125 or a boiler 127 or a power supply (FIG. 14). The boiler is provided with a hose, which is connectable to an iron having an inlet (not shown). The water tank 125 is arranged for providing water to the boiler in a manner known per se. In this way steam can be generated and supplied to the iron. The iron can thus function as a steam iron. The iron can thus cooperate with the ironing board.

FIG. 15*a* schematically depicts a first embodiment of a torso-shaped body according to the invention, where the work surface has a contour 141, which corresponds to the contour of a longitudinal section of a torso.

FIG. 15*b* schematically depicts a second variant of a torso-shaped body according to the invention having a contour 143.

The torso-shape may be symmetrical relative to an axis III-III.

In an embodiment of the ironing board according to the invention, the board has a refreshing mode. In this mode the user can refresh articles by hanging them over the body 5, the body being in a substantially vertical position (see FIG. 6*b*).

The article can be for instance a jacket, a blazer, a blouse or a shirt. The article may be buttoned and thus closed at the what is usually called front side of the article. In this way the shoulder parts hang over the shoulder (for example: 142 in FIG. 15*a*, or, alternatively, 144 in FIG. 15*b*) of the body 5. A non-button article like a dress or a sweater may be hung over the body in such a way that the shoulder straps or shoulder parts rest on the shoulders of the body. In both descriptions the body is dressed with the article. Alternatively the article may hang on a hanger and the hanger is connected to the body. The user activates the electrical unit to start the fan 133. The fan 133 produces an air stream. The activation is done using the control unit 135. The control unit may for instance be located at any place at the back of the body so that the user can easily reach it. Alternatively, the control unit comprises a remote control 137.

The fan activation can also be done from a garment steamer (if present). In this case, garment refreshing is accelerated with the use of steam from the garment steamer, and assisted with air (which could be warmed with a heater) from the board.

In an embodiment according to the invention the air flows through a permeable work surface. In case the body has multiple parts, the air is guided via air guiding means for guiding air, mobilised during use by the fan 131, from one part of the body to another part of the body and vice versa.

The air guiding means comprises a first wall portion of the first part of the body 107 (FIG. 13), which first wall portion is being located near the folding means 103 and a second wall portion of the second part of the body 109, which second wall portion is located near the folding means, and which first and second wall portions are provided with corresponding openings 105.

In an alternative embodiment the body is equipped with vents 131 (FIG. 14), the vents 131 are opened and the air stream is mainly blown out of the vents located at opposite sides of the body. Now an air stream flows towards the sleeves and the upper part of the article. In this way the armpit region, known as a sweat area, is especially refreshed.

In an embodiment of the ironing board 2 according to the invention depicted in FIG. 16, the ironing board comprises a height adjustment means to adjust the distance of the body 5 relative to the base 1. In FIG. 16 a schematic embodiment of the height adjustment means is depicted showing the column 7 equipped with a stationary frame 31 secured to the base 1 and a moveable frame 33 secured to the body 5. The stationary frame 31 has a guiding means 35 for guiding the movable frame 33. In FIG. 17 an alternative embodiment of the height adjustment means is shown. In this embodiment the ironing board comprises a second movable frame 34. The second movable frame 34 moves relative to the stationary frame 31 and the movable frame 33 moves relative to the second movable frame 34.

The height adjustment means is shown in more detail in FIGS. 18, 19 and 20.

In these figures is depicted that a second button 39 is connected to a shaft 40. The shaft 40 is connected to a strip lift 41 via a second connector 42 (FIG. 19). A lever lift 43 (FIG. 20) is secured to the strip lift 41 and cooperates with an index plate 45.

To adjust the height the user pushes the second button 39 towards the body. In this way the shaft 40 is rotated in the direction of the arrow F (see FIG. 19). As a result the strip lift 41, connected to the shaft 40 via the second connector 42, is moved down. As a result, the lever lift 43 is released (unlocked) from the index plate 45 (or alternatively a gear train) (see FIG. 20). The user may now (while pushing the second button 39) pull the body 5 up or push it down because the movable frame 33 can move freely using the guiding means 35 on the stationary frame 31. To lock the body in a desired height the user releases the second button 39 and the lever lift 43, serving as stopper means, slides in the nearest opening in the index plate 45.

In order to facilitate the height adjustment so that the used does not have to apply a force to lift the weight of the body and the frame connected to it, an ironing board according to the invention is preferably equipped with means of exerting a repelling force on the body. Such a force is a force on the body directed away from the base. This force may be provided by electrical, magnetic, hydraulic, pneumatic or mechanical means.

In an embodiment according to the invention the weight of the body 5 is compensated during height adjustment by a constant-force spring 37 (see FIG. 18). The constant-force spring 37 is at one end 38 fixed, by means of common fixing means, such as a screw or a mounting bridge, to the stationary frame 31 (visualised in FIG. 16) and the other end connected to the movable frame 33 (visualised in FIG. 16). The bottom 84 (shown in FIG. 16) of the movable frame 33 sits on the fastening means 30 of the constant-force spring 37. Because the body 5 (visualised in FIG. 16) is secured to the movable frame 33, the weight of both the body 5 and the movable frame 33 is compensated by the constant-force spring.

The invention claimed is:

1. An ironing board comprising a base, a body with a work surface, wherein the body is connected to the base, and a height adjuster configured to adjust a distance of the body relative to the base, wherein the height adjuster comprises a column equipped with a stationary frame secured to the base, a moveable frame secured to the body and a forcing device configured to exert a repelling force between the body and the base, wherein the base includes a portion which is configured to slide out to increase a size of the base in response to tilting the body from a vertical position to a horizontal position.

2. The ironing board of claim 1, wherein the stationary frame and the movable frame are moveable alongside each other.

3. The ironing board of claim 1, wherein the stationary frame has a guide configured to guide the movable frame.

4. The ironing board of claim 1, wherein the forcing device comprises an electrical, magnetic, hydraulic, pneumatic or mechanical device.

5. The ironing board of claim 1, further comprising a weight compensation device configured to compensate a weight of the body and the moveable frame.

6. The ironing board of claim 5, wherein the compensation device comprises a force spring.

7. The ironing board of claim 5, wherein the force spring comprises a substantially constant-force spring.

8. The ironing board of claim 1, wherein the column comprises a column locking device configured to lock the movable frame into position.

9. The ironing board of claim 7, wherein the column locking device comprises a stopper unit and an array of receiving units, wherein the array of receiving units is secured to one of the stationary frame and the moveable frame and the stopper unit is secured to another of the stationary frame and the moveable frame.

10. The ironing board of claim 1, further comprising at least one of a heater for heating the work surface, a fan for blowing or sucking air through the work surface of the body and a boiler for providing steam.

11. The system of claim 10, further comprising an iron and/or garment steamer for cooperation with the ironing board, and characterized in that the boiler is being arranged for providing steam to the iron and/or garment steamer.

12. A system comprising an ironing board according to claim 1 and an iron and/or garment steamer for cooperation with the ironing board.

13. The system of claim 12, wherein the board has a storage device configured to store the iron and/or garment steamer.

14. An ironing board comprising a base, a body with a work surface, wherein the body is connected to the base, and a height adjuster configured to adjust a distance of the body relative to the base, wherein the height adjuster comprises a column equipped with a stationary frame secured to the base, a moveable frame secured to the body and a forcing device configured to exert a repelling force between the body and the base, wherein the column comprises a column locking device configured to lock the movable frame into position, wherein the column locking device comprises a multi-step gear train and a stopper, and wherein the gear train is secured to one of the stationary frame and the moveable frame and the stopper is secured to another of the stationary frame and the moveable frame.

15. The ironing board of claim 14, wherein the base includes a portion which is configured to slide out to increase a size of the base in response to tilting the body from a vertical position to a horizontal position.

16. The ironing board of claim 14, further comprising a weight compensation device configured to compensate a weight of the body and the moveable frame.

17. The ironing board of claim 16, wherein the compensation device comprises a force spring.

18. The ironing board of claim 14, wherein the column comprises a column locking device configured to lock the movable frame into position.

* * * * *